US005513589A

United States Patent [19]

Frigerio

[11] Patent Number: 5,513,589

[45] Date of Patent: May 7, 1996

[54] TIE-TIPPING APPARATUS WITH SHIFTING PINCH MEMBERS

[75] Inventor: Giorgio Frigerio, Villa Guardia, Italy

[73] Assignee: Frigerio & Corazza S.n.c. di Frigerio Giorgio & Corazza Anna Marie, Como, Italy

[21] Appl. No.: 261,828

[22] Filed: Jun. 17, 1994

[30] Foreign Application Priority Data

Jun. 17, 1993 [IT] Italy ..... MI93A1301

[51] Int. Cl.[6] ..... D05B 21/00

[52] U.S. Cl. ..... 112/470.26

[58] Field of Search ..... 112/470.07, 470.09, 112/470.16, 470.18, 470.26, 470.33, 475.06, 475.08, 475.09

[56] References Cited

U.S. PATENT DOCUMENTS

| | | | |
|---|---|---|---|
| 4,574,717 | 3/1986 | Jünemann et al. | 112/470.16 |
| 4,643,115 | 2/1987 | Jünemann | 112/407.26 |
| 4,644,885 | 2/1987 | Bennison | 112/470.26 |
| 4,719,863 | 1/1988 | Bisson | 112/470.07 |
| 4,869,185 | 9/1989 | Scholl et al. | 112/470.16 |
| 5,280,759 | 1/1994 | Scholl | 112/470.07 |

FOREIGN PATENT DOCUMENTS

| | | | |
|---|---|---|---|
| 0416641 | 3/1991 | European Pat. Off. | 112/470.26 |

*Primary Examiner*—Isamel Izaguirre
*Attorney, Agent, or Firm*—Kuhn and Muller

[57] ABSTRACT

A tie-tipping apparatus is provided for the sewing and finishing of tie tips and the use of same through the use of properly modified and integrated sewing machines. The apparatus includes a base and a cover, each of similar form to the tie tip. The fabrics to be sewn are positioned between the base and the cover and, by the use of a lever system, instruments of friction are shifted, properly placed on the cover, which pull the upper fabric and take it to assume a configuration which allows for the sewing through an appropriate sewing slot. The tie-tipping apparatus permits an easier positioning of the fabrics, and the possibility to regulate the sewing rim in a different way along the sides of the tip and along the flanks and the possibility of use in an automated work circuit.

33 Claims, 9 Drawing Sheets

TIE-TIPPING APPARATUS WITH SHIFTING PINCH MEMBERS

FIELD OF THE INVENTION

This invention concerns an apparatus for the sewing and finishing of tie tips and its use through the use of properly modified and integrated sewing machines.

BACKGROUND OF THE INVENTION

As is known, the tie is produced using a strip of fabric with the ends cut in a tip shape, which is sewn to the lining and subsequently folded again in a proper way.

The sewing carried out with automated machines presents particular problems regarding the quality of the results in comparison with the sewing carried out with a traditional machine. These problems have been partially resolved with the tie tip finishing apparatus disclosed in U.S. Pat. No. 4,644,885 of Bennison. In the aforementioned patent, a device for the sewing of tie ends is disclosed, including a base on which is placed a first fabric on which, in turn, is placed a blade having upward protruding borders at one or more corners. Thus, by superimposing on it another properly conformed fabric, by closing said fabrics and the blade between said base and a cover, and through said upward protruding borders, upward folds are formed on the upper fabric at the corners in such a way so as to allow the sewing of the two fabrics along the respective entire contour.

While this allows that the lining be sewn to the entire external border of the fabric at the ends of the tie, said device of Bennison presents several inconveniences. First, when it is necessary to position the borders of the fabric to be sewn in the device of Bennison, one must be very careful that the upper fabric is placed further than the other fabric because, otherwise, when the cover is closed, the lower fabric backs up with respect to the upper fabric, causing evident unaesthetic effects after that the sewing has been performed. This operation described in Bennison requires a certain care on the part of the operator with the possibility, however, of having poor results when this operation is done without proper care.

Another serious inconvenience of the prior art of Bennison is the impossibility of being able to vary, with the same apparatus, the size of the rim. The possibility to be able to vary the size of the rim along the sides of the tip and flank in an independent manner is often important, since it is often required by the stylists who wish to offer a high quality product with hand type finishing. Further, the saving of material attained by reducing the rim, though apparently little, can be important, taking into account the high cost of fabric used, such as, very often silk.

Again, with the goal of reducing the cost of production of ties, it would naturally be desirable to be able to realize equipment which permits the use of one or more of tie tipping apparatus' in a work circuit which allows for the sewing of tie ends in succession, one after the other, reducing as much as possible the amount of dead time. The prior art tie sewing device of Bennison does not provide a completely automated work cycle, with the exception of inevitable and unproductive manual loading and unloading.

OBJECTS OF THE INVENTION

An object of the present invention is to improve upon the inconveniences and disadvantages of the prior art and, in particular, to realize a tie-tipping apparatus in which the fabrics to be sewn are placed in a perfectly superimposed manner, while avoiding having to position one fabric a little behind the other fabric, and avoiding, thus, the possibility of the incorrect insertion of the fabrics, with the attainment, instead, of a perfect parallel positioning of the fabrics, after the formation of the pinches at the corners of the tie.

A further object of the invention is to provide a tie-tipping apparatus which enables the user to vary the sizes of the rim on the flanks independently from the rim on the sides of the tip, for purely aesthetic purposes and to save material.

A still further object of the invention is to be able to use said apparatus in a work circuit which considerably reduces the time necessary to sew each tie, reducing as much as possible the dead time and the work of the operator.

SUMMARY OF THE INVENTION

In keeping with these objects and others which may become apparent, the tie-tipping apparatus of the present invention includes features for accurately sewing the two fabrics of a tie tip, and a machine for the use of the tie-tipping apparatus wherein the apparatus is accurately placed upon the fabrics of a tie tip. Further advantageous characteristics of the tie-tipping apparatus and of the machine are set forth in the annexed claims.

DESCRIPTION OF THE DRAWINGS

The characteristics, the objects and the advantages of the invention will become more evident from the following description and from the accompanying drawings of an embodiment merely by way of non-limiting example in which the various drawings in which.

Figure 9:
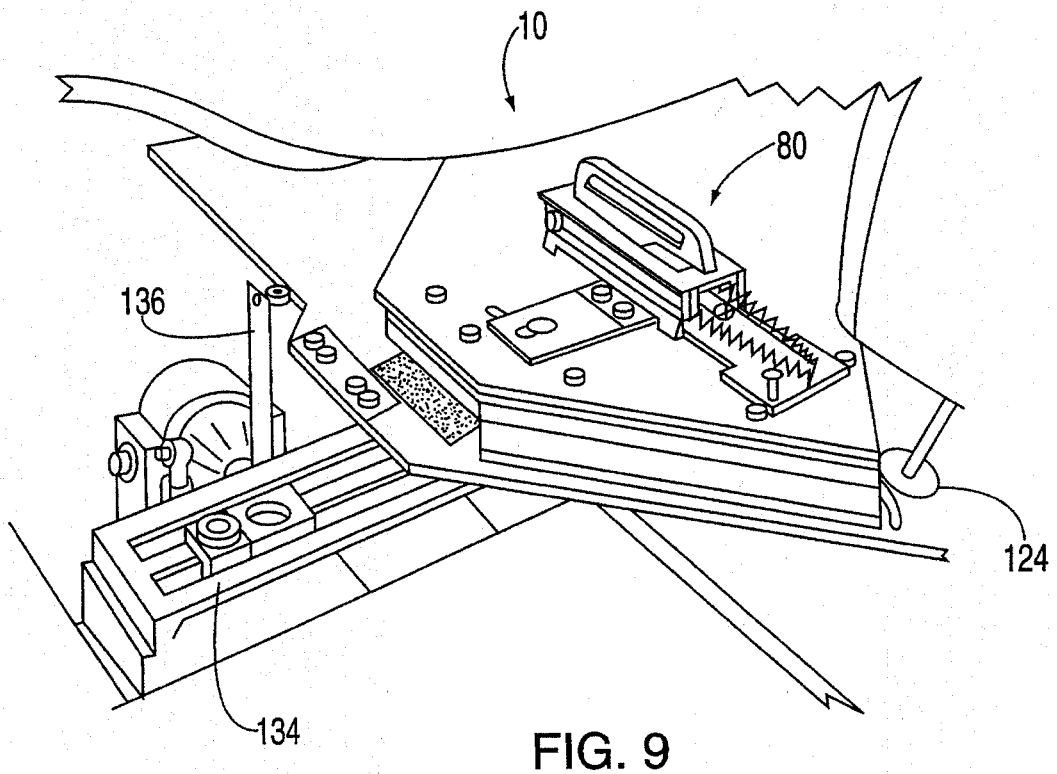
Figure 10:
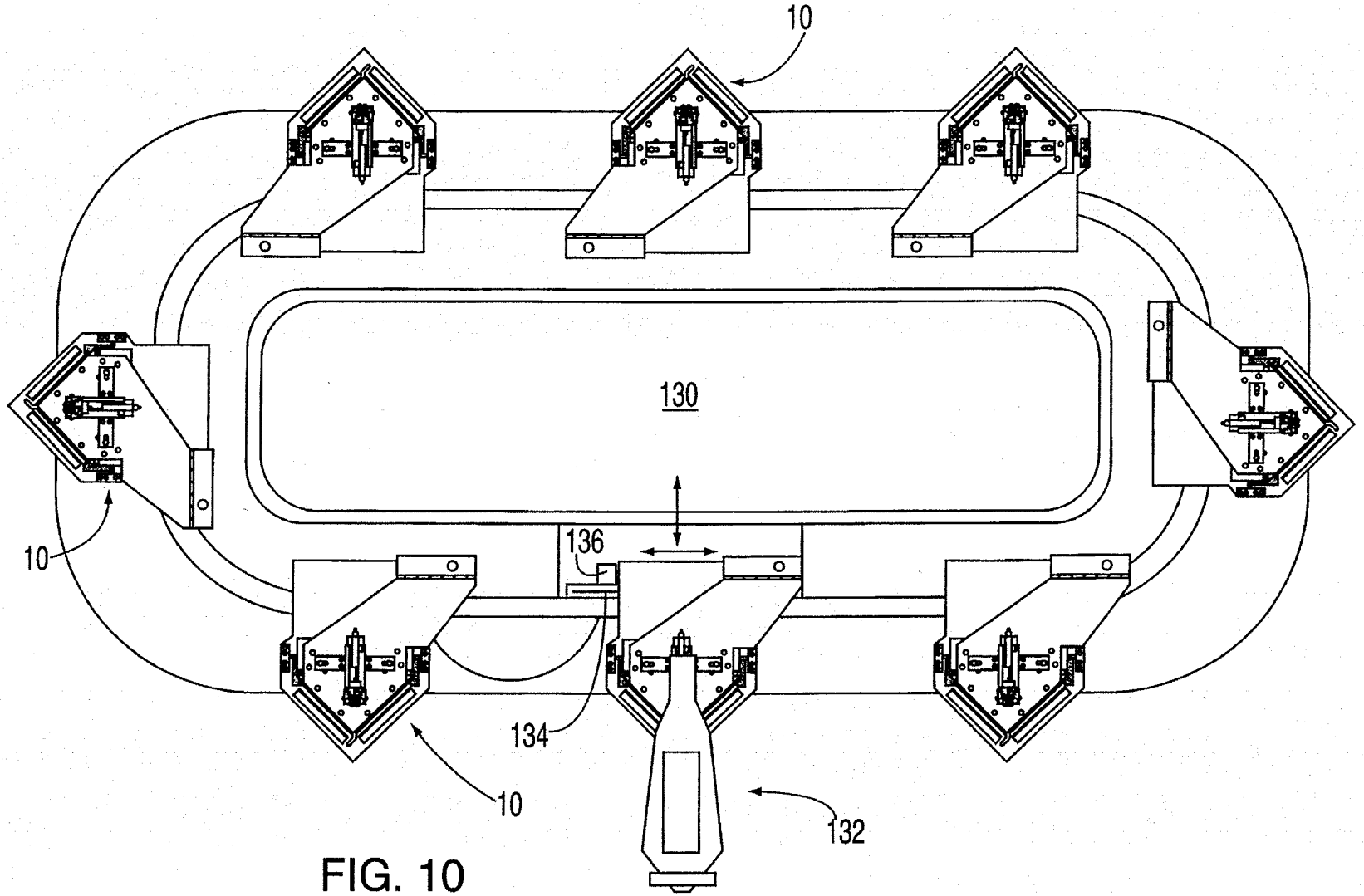

FIGS. **8*a*–8*c*** are enlarged diagrammatic partial views of the pinches in proximity to the tip and the lateral corners of the tie tipping apparatus;

FIG. 9 is a close up perspective view of the pusher devices shown on the tie-tipping apparatus as in FIGS. 1–6; and FIG. 10, is a top plan view of a work circuit with a plurality of tie-tipping apparatuses.

DETAILED DESCRIPTION OF THE PREFERRED EMBODIMENT

Figure 1:
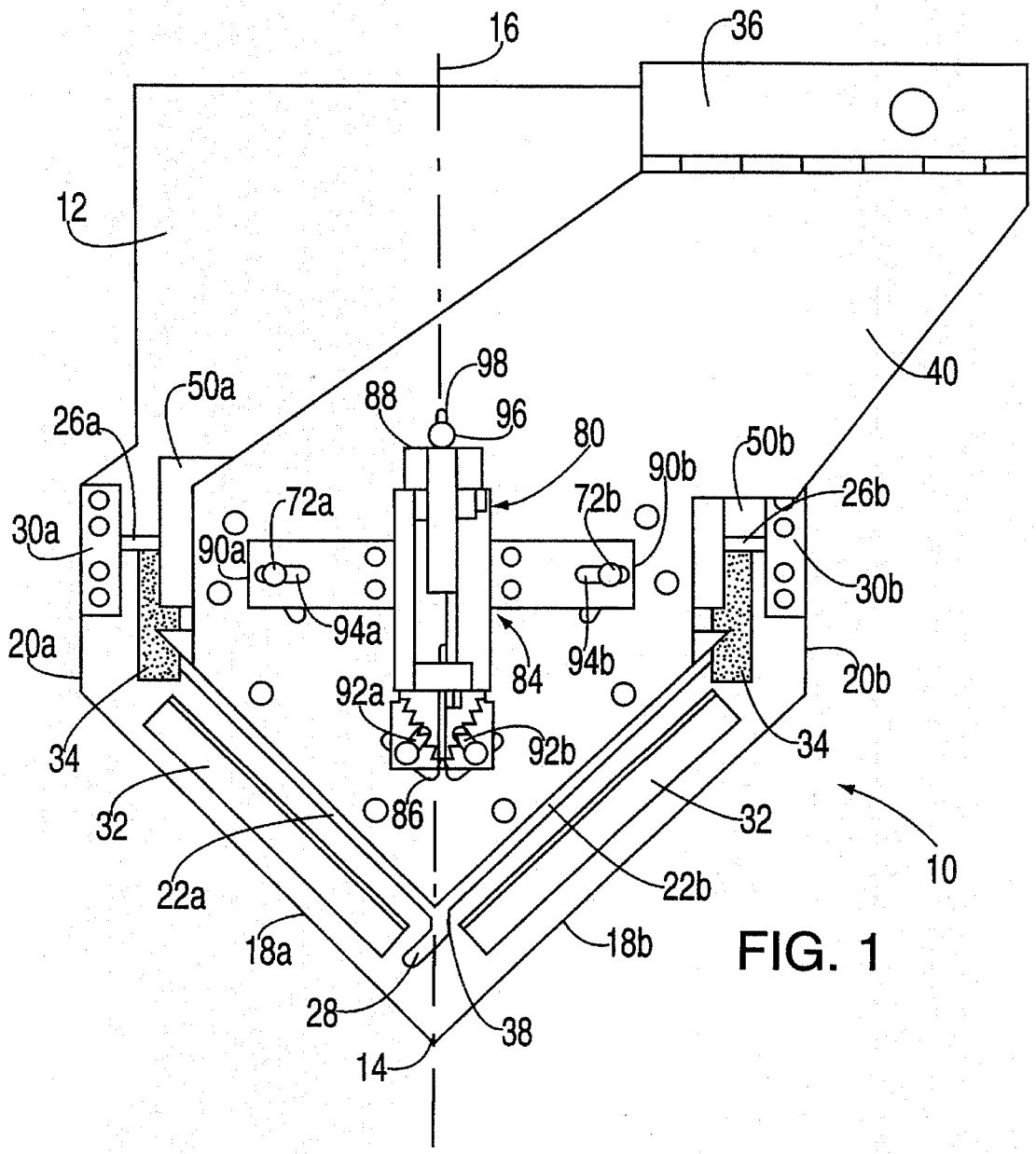
FIG. 1 is a top plan view from above of the tie-tipping apparatus with the lever up.

FIG. 1 illustrates the entire device seen from above. Obviously, the same characters in the various figures indicate the same or equivalent parts.

Figure 2:
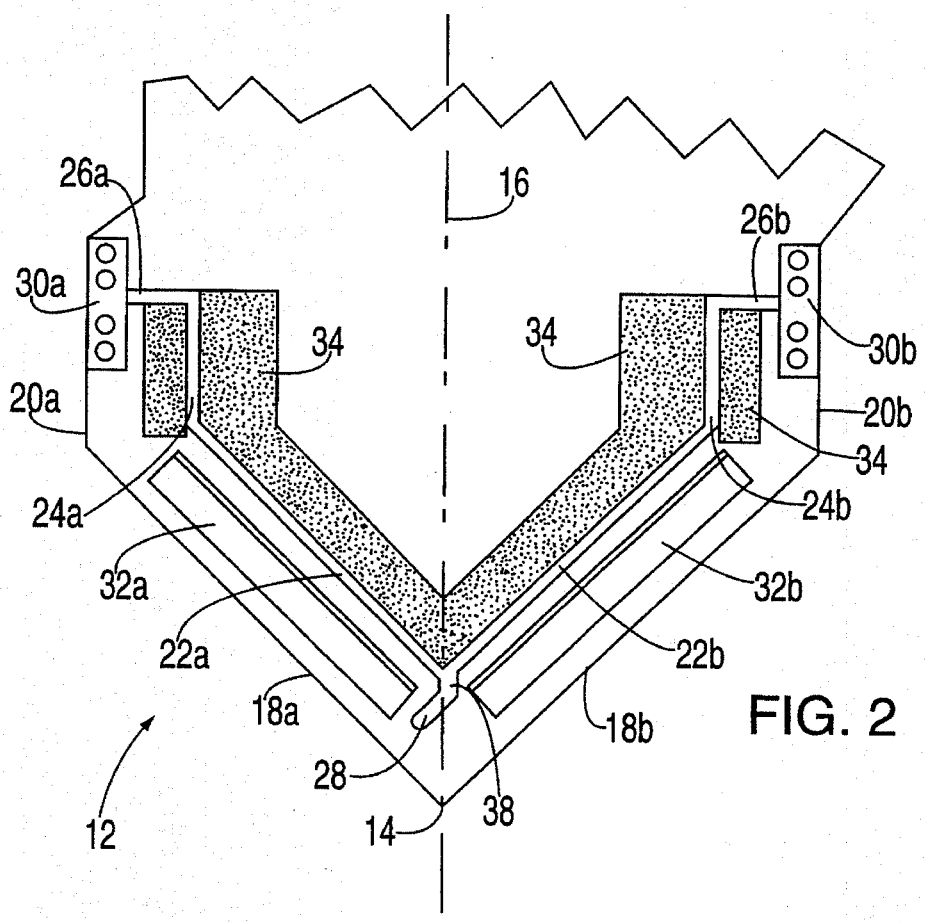
FIG. 2 is a top plan view from above of the tip area of the upper face of the base of the tie-tipping apparatus as in FIG. 1.

With reference to FIG. 2, the form of the lower base 12 can be more clearly seen wherein the base form is, similar to that of the cover 40. It is irregular but shows, as seen from above, a tip 14 corresponding to the tie tip and an axis 16 coinciding with the tie axis itself.

Looking, thus, at FIG. 2, with the base of the tie-tipping apparatus placed with the tip 14 downward, a symmetrical shape is seen with respect to axis 16, with two tip sides 18*a*, 18*b* convergent in the base tip 14 and two base flanks 20a, 20b parallel to base axis 16. Also with reference to FIG. 2, a sewing slot, is shown. The sewing slot is shaped as a piecewise linear slot and it comprises tip slot sides 22*a*, 22*b*, and slot flanks 24*a*, 24*b*, parallel to base tip sides 18*a*, 18*b* and to base flanks 20*a*, 20*b*, respectively.

Sewing slot defined by tip slot sides 22*a*, 22*b* is connected to external base contour 12, by two further slot parts 26*a*, 26*b*, essentially perpendicular to two slots flanks 24*a*, 24*b*.

Tip slot side 22*b* extends further toward tip side 18*a*, through a slot extension 28, essentially in a direction parallel to tip side 28*b* of the slot and toward tip side 18*a*.

The two parts of base 12, divided by the sewing slot, are connected by small plates 30*a*, 30*b*, connected near base flanks 20*a*, 20*b*. In the strips between base sides 18*a*, 18*b* and tip slot sides 22*a*, 22*b*, wall means 32*a*, 32*b* are provided essentially parallel to tip sides as to define an exact placement position of the fabrics (not shown) to be sewn together.

Along the entire sewing slot, or part of it, there are provided attrition means 34 to avoid the slipping of the fabric from the placement position. In the present embodiment, attrition means 34 consists of strips of sand paper.

Base 12 is hinged along its side, preferably the one opposite to tip 14, to cover 40 by hinge 36.

Figure 5:
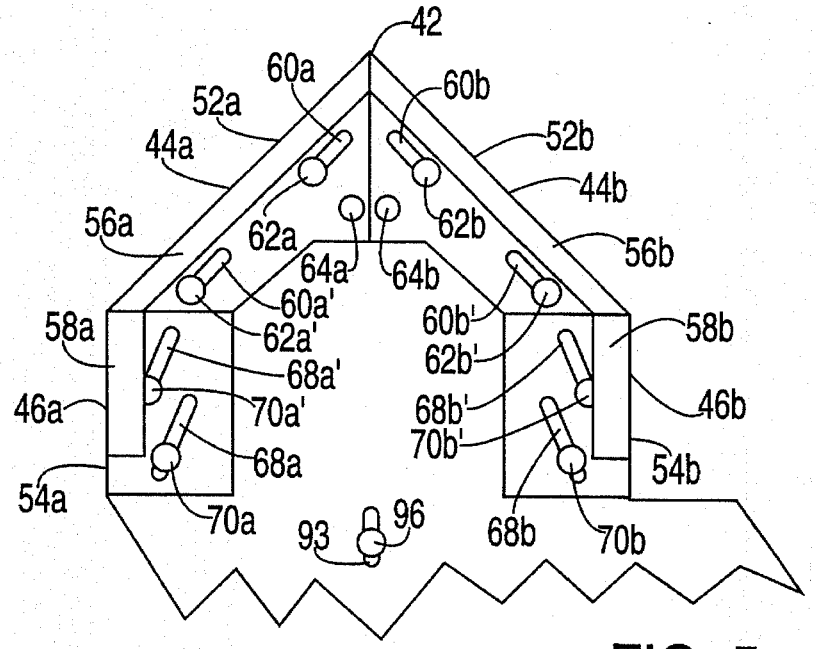
FIG. 5 is a partial view of lower face of the cover of the tie-tipping apparatus with the lever down.
Figure 3:
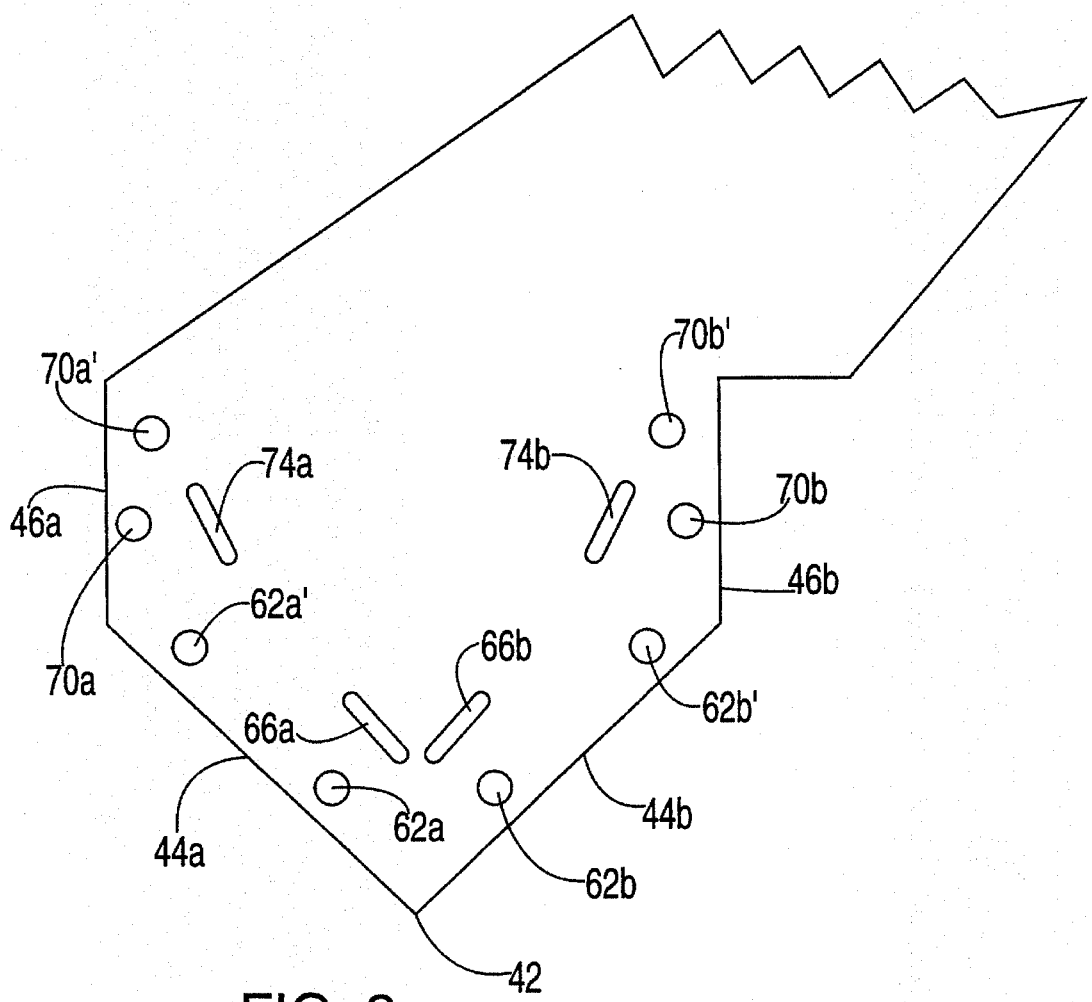
FIG. 3 is a partial top plan view from above of the cover of the tie-tipping apparatus as in FIG. 1 without the lever mechanism.

As shown in FIGS. 1, 3 and 5, cover 40 is also of an irregular form but is shaped in such a way that, superimposing it on base 12, two tip sides 44*a*, 44*b* and two flanks 46*a*, 46*b* follow the internal contours of the sewing slot on the base along slot tip sides 22*a*, 22*b* and slot flanks 24*a*, 24*b*, respectively.

Figure 6:
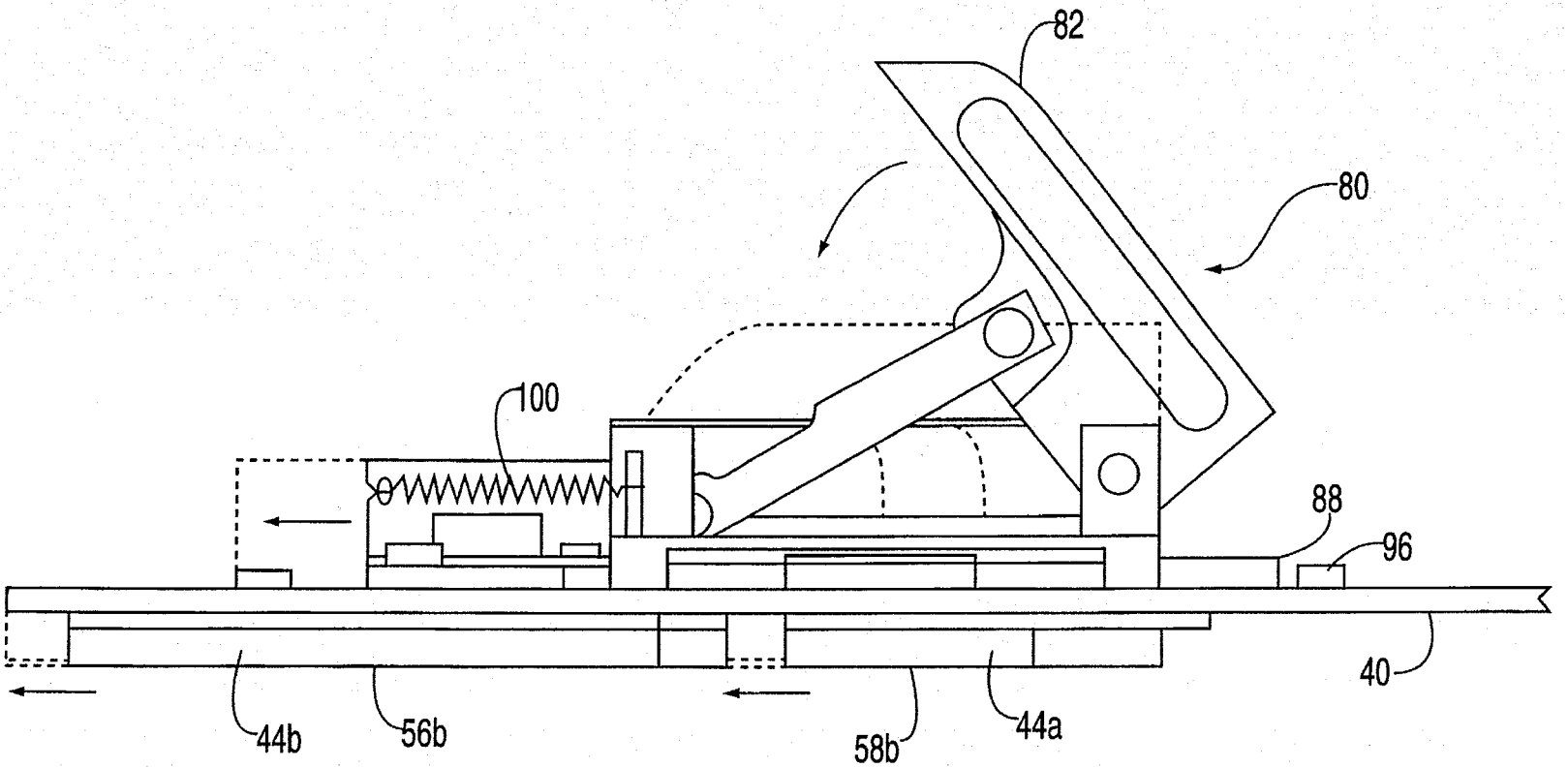
FIG. 6 is a side elevational view of command lever device of the tie-tipping apparatus, shown mounted on the cover.

As shown in FIGS. 1 and 6, on the external face of cover 40, along its axis of symmetry, a lever mechanism 80 is connected.

Lever mechanism 80 acts on surface tip parts 48*a*, 48*b* and on surface flank parts 50*a*, 50*b*, adapted to graze the lower face of cover 40, making them shift in the predetermined directions.

Surface parts 48*a*, 48*b*, 50*a*, 50*b* show their respective external sides 52*a*, 52*b*, 54*a*, 54*b* parallel to tip sides 44*a*, 44*b* and to flanks 46*a*, 46*b* of the cover, respectively.

Along external sides 52*a*, 52*b*, 54*a*, 54*b* of respective surface parts 48*a*, 48*b*, 50*a*, 50*b* are connected friction means 56*a*, 56*b*, 58*a*, 58*b*, such as rubbery surfaces.

External sides 52*a*, 52*b* of respective surface tip parts 48*a*, 48*b* are essentially superimposed on respective cover sides 44*a*, 44*b* but slightly behind tip 42 with the lever in a lever-raised position, while they coincide perfectly with these when in a lever-lowered position.

Similarly, external sides 54*a*, 54*b* of respective flank surface parts 50*a*, 50*b* are parallel but slightly more outward with respect to respective cover flanks 46*a*, 46*b*, with the lever in a lever-raised position, while they essentially coincide when in a lever-lowered position.

On each of surface tip parts 48*a*, 48*b*, first guide grooves 60*a*, 60*a*', 60*b*, 60*b*' are provided, parallel to respective external sides 52*a*, 52*b*, within which first screws 62*a*, 62*a*' and 62*b*, 62*b*', connected on the cover, glide.

On the contrary, at each of surface tip parts 48*a*, 48*b* are connected second screws 64*a*, 64*b*, directly connected to a lever mechanism 80, which glide within second guide grooves 66*a*, 66*b*, milled on the cover parallel to tip sides 44*a*, 44*b* of cover 40.

In the same way, on each of flank surface parts 50*a*, 50*b*, are provided third guide grooves 68*a*, 68*a*', and 68*b*, 68*b*', respectively, with an axis inclined at a certain angle with respect to the cover axis, in which glide third screws 70*a*, 70*a*' and 70*b*, 70*b*', respectively, are connected to cover 40. In addition to each of flank surface parts 50, 50 are connected fourth screws 72*a*, 72*b*, which screws 72*a*, 72*b* are directly connected to lever mechanism 80, and which screws 72*a*, 72*b* glide within fourth guide grooves 74*a*, 74*b*, provided on the cover and parallel to third grooves 68.

As shown in FIG. 1, lever mechanism 80 is connected to the upper cover face and permits, by lowering lever 82, the shifting of cross surface 84 toward tip 42 along the cover axis. Cross surface 84 has a first end 86 adjacent to tip 42; a second end 88 opposite the prior one wherein the first end 86 and second end 88 define a first arm, and third and fourth ends 90*a*, 90*b* are on an axis perpendicular to the cover axis and which third and fourth ends 90*a*, 90*b* are placed in proximity to over flanks 46*a* and 46*b* themselves, wherein the third and fourth ends define a second arm.

At first end 86 are provided a first and a second gliding groove 92*a*, 92*b*, perpendicular to second guide grooves 66*a*, 66*b*, respectively, provided on the cover 40, and within which first and second gliding grooves the aforesaid second screws 64*a*, 64*b* glide.

Second end 88 is placed against stud 96 which can be shifted along the axis 16, and which is able to glide in stud groove 98 and to be subsequently fixed in a desired position as to define the longitudinal lever system position.

At third and fourth ends 90*a*, 90*b* are respectively provided third and fourth gliding grooves 94*a*, 94*b*, in which fourth screws 72*a*, 72*b* glide.

Lever 82 is shaped in such a way that, to act on it, it is necessary to press downward so that the cover presses against the base. To increase the force, return springs 100 have been added which, in addition, return lever 82 to the raised position, using a light force on the free end of lever 82.

OPERATION OF THE PRESENT INVENTION

The operation of the tie-tipping apparatus, according to the present invention is the following.

First, cover 40 is raised and the two fabrics to be sewn are positioned together along the borders, with borders are placed against wall means 32*a*, 32*b*.

In this connection, it is useful to specify that it is necessary to position the two fabrics on top of each other with the tip sides mating and not, as in the prior art of Bennison, placing one fabric ahead of the other fabric, thereby avoiding possible mistakes and useless waste of time.

After closing cover 40, one acts on lever 82, pressing its free end downward. In this way, friction means 56*a*, 56*b*, 58*a*, 58*b* are shifted to make them coincide with respective tip sides 44*a*, 44*b* and flank sides 46*a*, 46*b* of cover 40.

Figure 8:
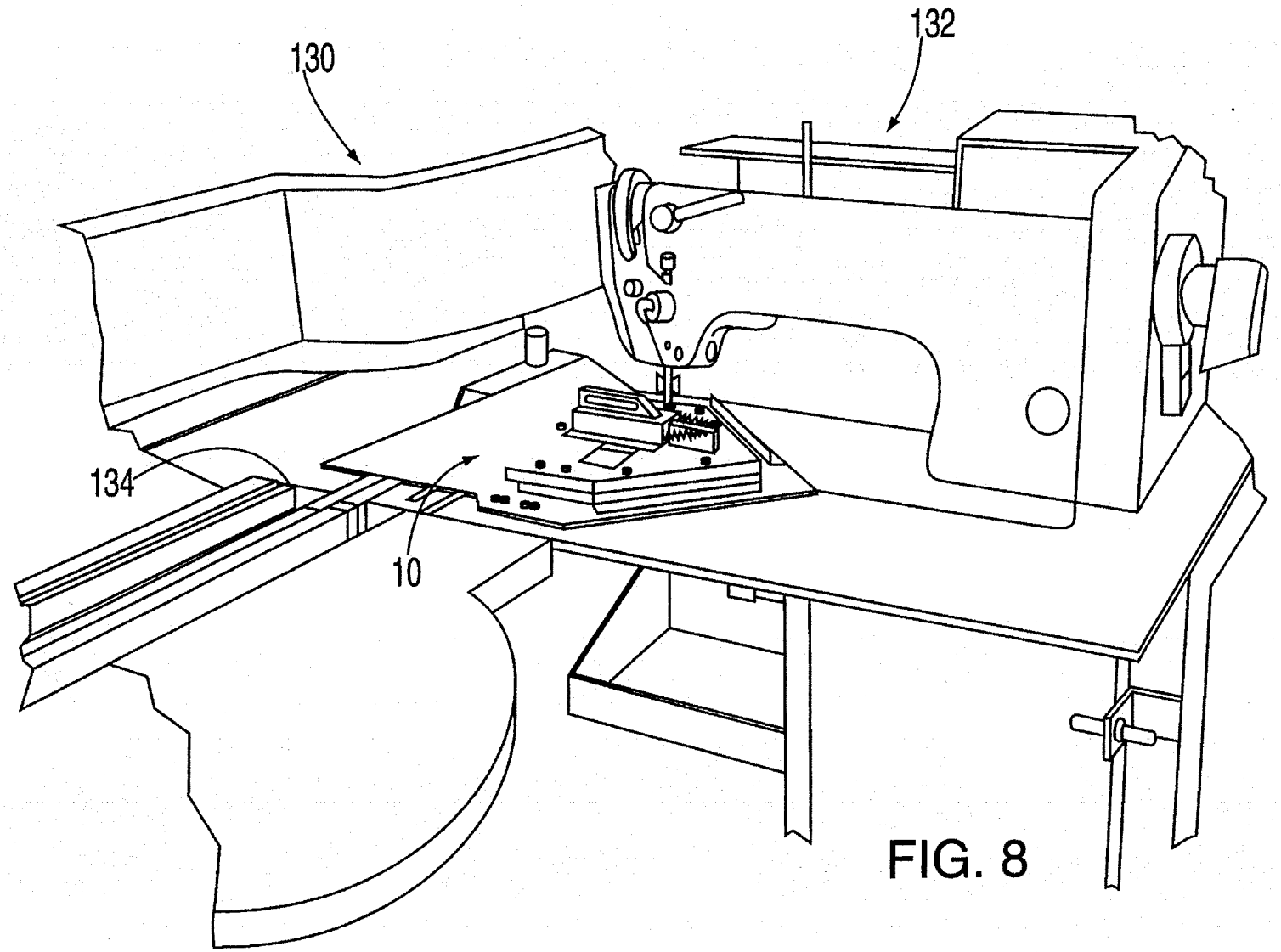
FIG. 8 is a partial perspective view of the work circuit machine used with the tie-tipping apparatus as in FIGS. 1–6.
Figure 8A:
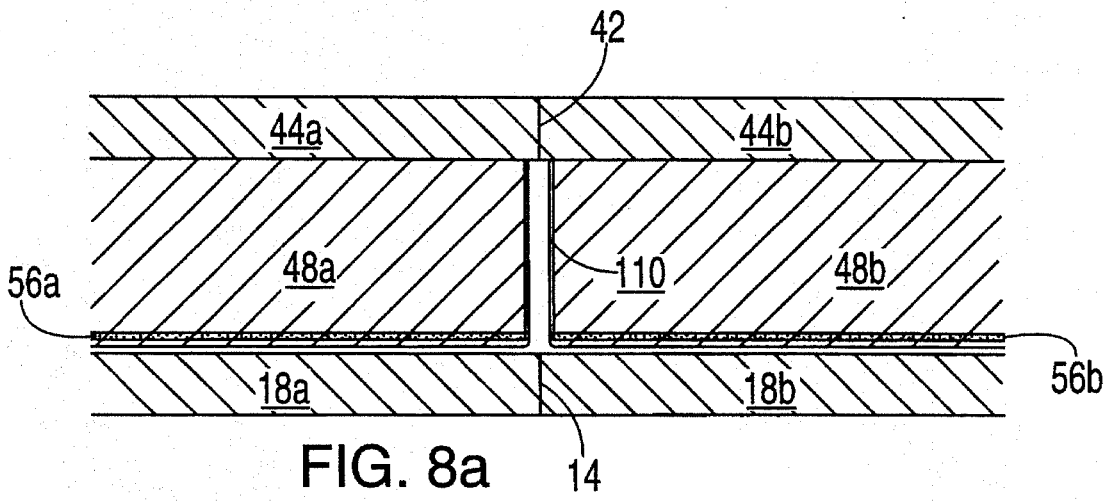
Figure 8B:
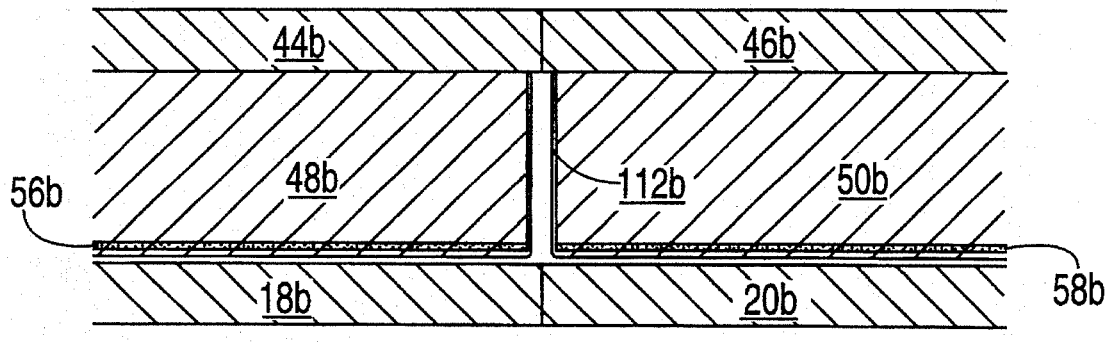
Figure 8C:
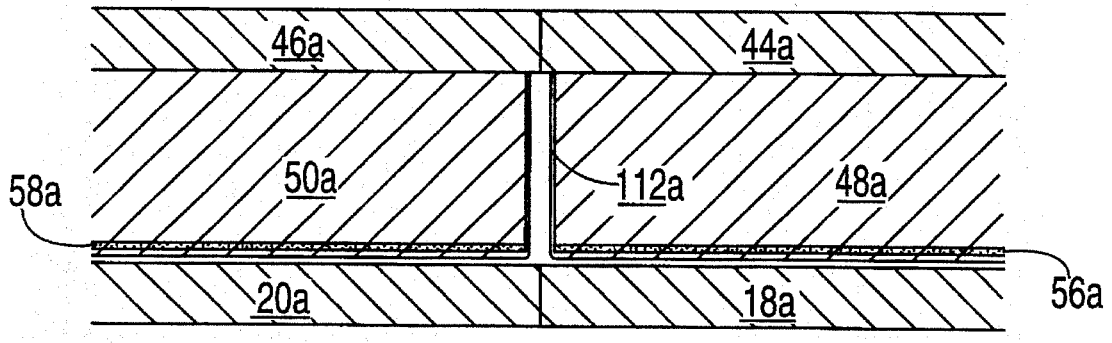

This downward movement of lever 82 generates, at tip 42 and at the other two corners of cover 40, pinches 110, 112*a*, 112*b*, as shown in FIGS. 8*a*–8*c* rising upward from the upper fabric, which is tightened between the adjacent ends of friction means 56, 58.

The shifting of friction means 56, 58, rigidly connected to respective surface parts 48, 50, is due to the shifting of second and fourth screws 64*a*, 64*b* and 72*a*, 72*b*, guided by the lever mechanism into the respective grooves.

The presence of attrition means 34 on the base 12 causes that the lower fabric does not move during the generation of pinches. At this point, it is possible to carry out the sewing following the sewing slot with the needle.

Figure 7:
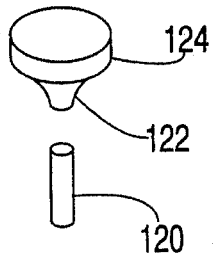
FIG. 7 is a close up view of the lower and upper guide of the sewing needle used with the tie-tipping apparatus as in FIGS. 1–6.

For this object, as shown in FIG. 7 a system commonly used on automatic machines for form sewing with lower needle guide 120, which is inserted in the sewing slot to define perfectly the sewing itself, has been used.

Upper needle guide 122 includes a circular rim 124 which is able to lean on upper cover face 40 next to and along the tip sides and the flanks. The greatest problems of sewing arise next to the tip sewing slot due to the presence of tip pinch 110.

The needle at tip pinch 110 cannot sew but must, when it is immediately adjacent, be raised up and, afterward, continue along the adjacent sewing side.

The problem has been resolved, providing that lower needle guide 120, when at the tip sewing slot, be guided to move within slot extension 28 while upper guide 122 is raised so as not to come in contact with tip pinch 110. Subsequently, lower guide 120 is guided to return back into slot extension 28 and, at the same time, upper needle guide 122 is lowered so that circular rim 124 is on the upper cover face, following the cover contour and continuing, thus, the sewing process.

As it can be clearly understood, the sewing operation can be done using a manually run sewing machine in the needle-raising, needle-lowering and apparatus moving phases, as is the case in the prior art embodiments, or in the alternative, these phases can be done automatically by computer. A computer controlled type of operation is not, on the contrary, possible in the prior art embodiments, in which it is necessary to rotate the apparatus with respect to the needle when the needle arrives next to the tip.

It is possible, thus, to use a plurality of tie-tipping apparatuses inserted in a circuit 130 as partially seen in FIG. 8 and completely shown in FIG. 10, which causes each apparatus to move toward sewing machine 132 for sewing, and away from said sewing machine after the sewing has been completed.

The needle and its respective upper and lower guides 122, 120 remain fixed but, next to the sewing machine, the apparatus is shifted by a properly programmed pantograph 134 in the direction perpendicular to the machine direction and it is engaged with proper small wheels 76 connected to the base next to the hinge 36.

The fact that the movement along this direction is sufficient to move the apparatus and, thus, carry out the entire sewing process results from the fact that a piston is provided which acts on a pusher device 136, essentially an arm which pushes the apparatus in the machine direction, whose action is controlled electronically. Two pusher devices 136 are provided to accommodate the different sizes of the apparatuses for the two ends of the tie.

In addition, means are provided to allow that the movement of the apparatus occurs with an increasing velocity from the needle lower dead point to the needle dead tip. In this way, there is a minor curling of the fabric and greater work speeds can be maintained.

Further, the sewing stitch is maintained at a constant length also along the tip sides through the variation of the speed of the apparatus, through a sensor system, which acts on a speed reducer. The sewing machine motor is also able to command directly the advancement of the pantograph through a system of belts and pulleys (not shown) in phase with the sewing machine.

Referring to tie-tipping apparatus 10, it is possible to vary the size of the sewing rim on the tip sides by simply acting on the stud 88 and connecting it in a position more or less advanced with respect to tip 42.

Figure 4:
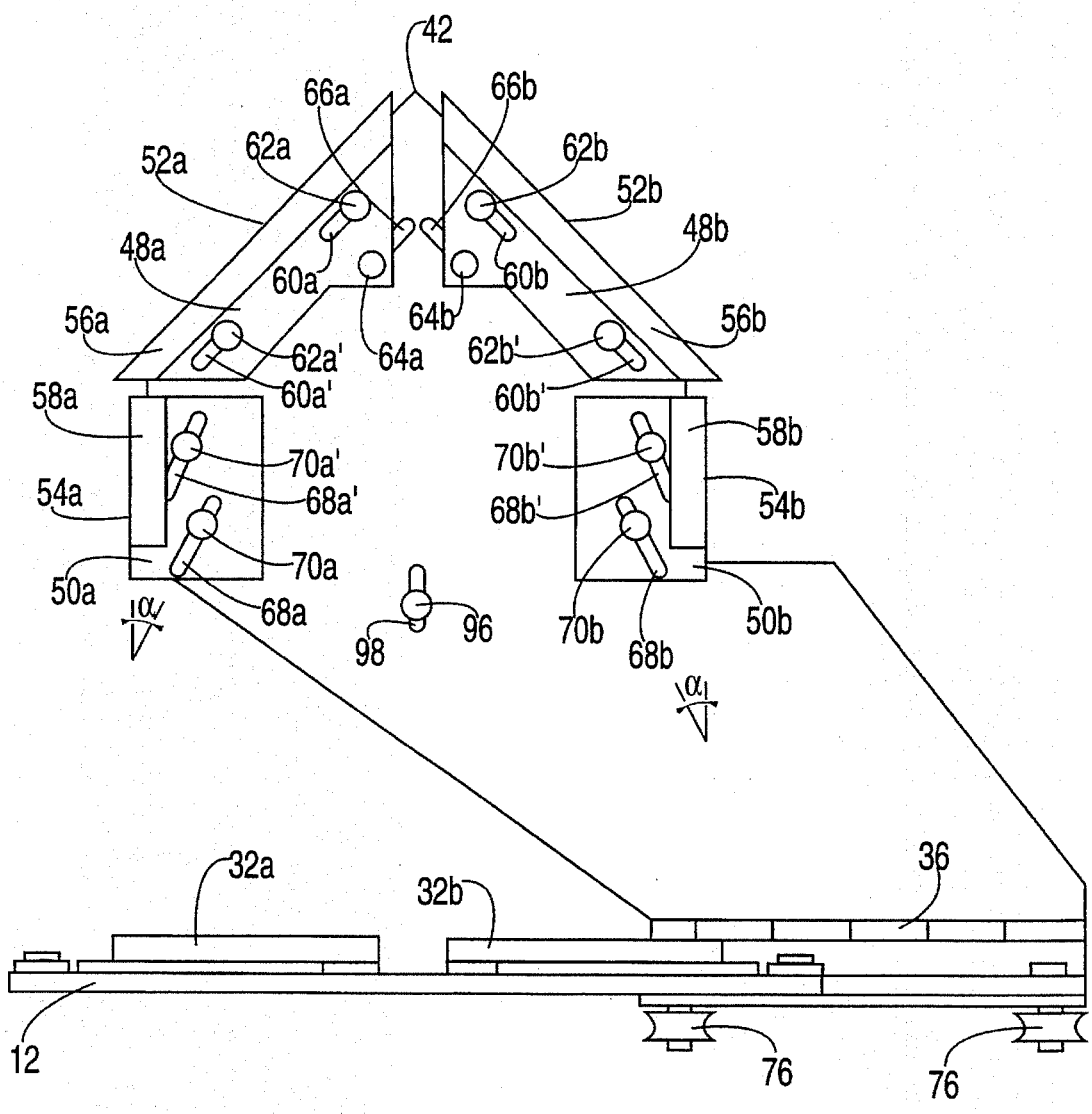
FIG. 4 is a side elevational view of lower face of the cover of the tie-tipping apparatus with the lever up.

In addition, as shown in FIG. 4, it is possible to regulate the rim sizes on the flanks by varying the inclination of the angle alpha: a value of alpha of 0 will reduce the rim size to zero while for greater alpha values, the same rim size will increase as a result.

In conclusion, the present invention fulfills the proposed objects and, in particular, permits the attainment of a tie tip sewing process which is able to determine the rim sizes along all the sides of the sewing line itself. It is not necessary to be particularly attentive in the positioning of the fabric and, moreover, it makes possible its use in a continuous work circuit.

It is evident that this embodiment is described merely by way of non-limiting example, and that numerous modifications, adaptions, supplements, variants and substitutions of elements with others which are functionally equivalent, can be made without going beyond the scope of the present invention, according to the following claims.

I claim:

1. A tie-tipping apparatus for sewing together an upper fabric with a lower fabric forming a sewing rim therebetween, said upper fabric and said lower fabric each having sides, said apparatus comprising a base shaped with a contour similar to a tie tip, on which said base the fabrics are disposed on the top of each other in such a way that the sides of both the fabrics coincide, said base having a continuous sewing slot following its contour and an attrition means disposed next to at least a part of said sewing slot; said sewing slot having a plurality of corners, said tie-tipping apparatus further having a cover hinged and shaped similarly to said base, said cover having an upper face and a lower face, tip sides and flank sides defining a contour with dimensions substantially coincident to said sewing slot in said base; said tie-tipping apparatus further having a friction means mounted to the lower face of said cover, said friction means being transactionally movable by a lever mechanism attached to said upper face of said cover as to form pinches on the upper fabric at the tip and at said corners of said sewing slot.

2. The tie-tipping apparatus as in claim 1, wherein said base further comprises a wall means disposed along said sewing slot tip sides, and against which said wall means said fabric tip sides lie, as to define the exact position of the two fabrics.

3. The tie-tipping apparatus as in claim 1, wherein said base sewing slot is shaped as a piecewise-linear slot having a slot tip, said slot tip sides being parallel to said base tip sides and said slot flank being parallel to said base flanks.

4. The tie-tipping apparatus as in claim 3, wherein said base sewing slot further comprises a slot extension substantially extending one of said slot tip sides from said slot tip.

5. The tie-tipping apparatus as in claim 3, wherein said base sewing slot further comprises a plurality of slot parts connecting said base flanks to said slot flanks.

6. The tie-tipping apparatus as in claim 1, further comprising a plurality of small plates connected near said base flanks to said slot flanks.

7. The tie-tipping apparatus as in claim 1, wherein said friction means mounted to said lower face of said cover comprises a friction means being disposed in proximity to said cover tip and said friction means being disposed at the said cover flanks.

8. The tie-tipping apparatus as in claim 1, wherein said lever mechanism is disposed symmetrically with respect to said flanks and said tip sides and said lever mechanism comprises:

a lever;

a cross surface, said cross surface having an arm disposed parallel to said cover flank sides and another arm disposed transversely to said cover flank sides, each said arm having a plurality of grooves; and return springs connected to said lever and to said cross surface.

9. The tie-tipping apparatus as in claim 8, wherein said plurality of cross surface grooves are engaged by said friction means screws, so that the movement of said cross surface, by said lever, causes the shifting of said friction means.

10. The tie-tipping apparatus as in claim 9, wherein said friction means at said cover tip are shiftable parallel to said cover tip sides.

11. The tie-tipping apparatus as in claim 8, wherein said grooves, disposed at the cross surface arm parallel to said cover flanks, are perpendicular to said cover grooves, at said cover tip.

12. The tie-tipping apparatus as in claim 8, wherein said grooves disposed at said cross surface arm, transverse to said cover flanks, are perpendicular to said cover flanks.

13. The tie-tipping apparatus as in claim 1, wherein said cover further comprises a plurality of cover grooves and a plurality of cover screws, and said friction means being mounted to said lower face of said cover comprises a plurality of friction means grooves and a plurality of friction means screws.

14. The tie-tipping apparatus as in claim 13, wherein said plurality of cover grooves comprises a plurality of grooves in proximity to said cover tip and a plurality of grooves in proximity to said cover flanks.

15. The tie-tipping apparatus as in claim 14, wherein said cover grooves in proximity to said cover tip are parallel to said cover tip sides.

16. The tie-tipping apparatus as in claim 14, wherein said cover grooves in proximity to said cover flanks are inclined on a predetermined angle with respect to said cover flanks.

17. The tie-tipping apparatus as in claim 16, wherein said predetermined angle is such that with the increase in its value, the sewing rim size along said flanks increases.

18. The tie-tipping apparatus as in claim 13, wherein said grooves of said friction means at said cover tip are substantially parallel to said cover tip sides.

19. The tie-tipping apparatus as in claim 13, wherein said grooves of said friction means, in proximity to said cover flanks, are inclined, as said cover grooves in proximity to said cover flanks.

20. The tie tipping apparatus as in claim 19, wherein said friction means at said cover flanks are shiftable in a direction inclined as said grooves of said flank friction means.

21. The tie-tipping apparatus as in claim 13, wherein said cover screws and said friction means screws engage said friction means grooves and said cover grooves, respectively.

22. The tie-tipping apparatus as in claim 1, wherein said cover further comprises a further groove and a stud movable into and fixable to said further groove, said stud defining a longitudinal position of said lever system.

23. The tie-tipping apparatus as in claim 1, further comprising a plurality of wheels connected to said lower face of said base.

24. A machine in combination with the tie-tipping apparatus of claim 1, said apparatus comprising;

a motor;

a work circuit designed as to transport said at least one tie-tipping apparatus;

a sewing machine provided with a sewing needle designed as to perform a sewing line forming a rim between the fabrics;

a sensor system to determine the exact position of said at least one apparatus with respect to said work circuit;

a pantograph provided next to the sewing machine as to shift said at least one tie-tipping apparatus in a direction perpendicular to the machine direction; and at least one electronically controlled pusher device pushing said at least one tie-tipping apparatus toward the machine direction.

25. The machine as in claim 24, wherein said sewing machine further comprises a lower needle guide engaging an interior of said sewing slot and an upper needle guide.

26. The machine as in claim 25, wherein said upper needle guide is elevatable at the beginning of a sewing, at the end of a sewing and when said needle is next to said pinch, in proximity to said tip, of said sewing slot, while said lower guide continues moving along said slot extension; and said upper needle guide is lowerable after said tip pinch to continue the sewing.

27. The machine as in claim 24, wherein said upper needle guide comprises a rim, which said rim follows and leans upon the upper cover face, along its said tip sides and flanks, when the sewing is carried out.

28. The machine as in claim 24, further comprising a system of belts and pulleys, said system being controlled directly by said motor of said machine.

29. The machine as in claim 28, wherein said system of belt and pulleys controls the movement of said pantograph.

30. The machine as in claim 24, wherein said pantograph engages each of said at least one tie-tipping apparatus through said plurality of wheels connected to said lower face of said base.

31. The machine as in claim 30, further comprising a means to allow that the movement of said at least one tie-tipping apparatus occurs with an increasing velocity from the needle lower dead point to the needle upper dead point.

32. The machine as in claim 31, further comprising a speed reducer, said speed reducer being actuated by said sensor system as to carry out a variation of the speed of said at least one tie-tipping apparatus during the sewing along said tip sides, said variation being in phase with the movement of said sewing machine.

33. The machine as in claim 24, wherein said at least one tie-tipping apparatus comprises a plurality of tie-tipping apparatuses.

* * * * *